United States Patent [19]

Hansen et al.

[11] Patent Number: 5,002,245

[45] Date of Patent: Mar. 26, 1991

[54] BAG AND RETAINER THEREFOR

[75] Inventors: Flemming Hansen, Bjert; Lars Gjelstrup, Kolding, both of Denmark

[73] Assignee: Lindknud Plast A/S, Vejen, Denmark

[21] Appl. No.: 394,355

[22] Filed: Aug. 15, 1989

[30] Foreign Application Priority Data

Aug. 17, 1988 [DK] Denmark ..... 4618/88

[51] Int. Cl.[5] ..... B65B 67/00

[52] U.S. Cl. ..... 248/99; 248/101

[58] Field of Search ..... 248/95, 99, 101

[56] References Cited

U.S. PATENT DOCUMENTS

| | | | |
|---|---|---|---|
| 396,561 | 1/1889 | Harrison | 248/99 |
| 1,351,094 | 8/1920 | Buckel | 248/99 |
| 2,188,047 | 1/1940 | Jones | 248/99 |
| 2,507,842 | 5/1950 | Waddill | 248/95 X |
| 2,815,186 | 12/1957 | Miller | 248/99 |
| 3,861,630 | 1/1975 | Ady | 248/101 X |
| 3,912,208 | 10/1975 | Grenetier | 248/99 |
| 4,069,994 | 1/1978 | Wharmby | 248/99 X |
| 4,339,099 | 7/1982 | Barton et al. | 248/101 |

FOREIGN PATENT DOCUMENTS

| | | | |
|---|---|---|---|
| 2711443 | 9/1977 | Fed. Rep. of Germany | 248/101 |
| 2824566 | 12/1979 | Fed. Rep. of Germany | 248/95 |
| 745203 | 5/1933 | France | 248/99 |

*Primary Examiner*—David L. Talbott

*Attorney, Agent, or Firm*—Darby & Darby

[57] ABSTRACT

In order to permit easy and hygienic disposal of e.g. sanitary towels in a cloakroom, a bag retainer can be fitted on the wall, and a bag (4) can be hung on the retainer. The retainer comprises a traversing resilient carrier rail (3) on which a bag is hung (4) which is provided with a flap (5) at its mouth and which is downwardly open and designed to fit the reception of the carrier rail (3). The flap (5) and the carrier rail (3) have sloping side edges (7, 8) and are dimensioned so as to allow the bag to slide further down over the carrier rail (3) once the bag is stretched lengthwise with a view to keeping the rim stretched and the bag closed.

When the mouth of the bag is to be opened, one pulls out the uttermost part of the mouth, and when the bag is to be closed, one lets go of the mouth part whereby the resilient carrier rail will close the mouth of the bag.

9 Claims, 2 Drawing Sheets

BAG AND RETAINER THEREFOR

BACKGROUND OF THE INVENTION

The invention is related to a bag and a retainer for fitting of the bag on a wall or the like, which retainer comprises means allowing the opposite top edges of the bag to be moved between a closed position in which the top edges are in close abutment and an open position in which they are spaced from each other.

Ladies' cloakrooms for instance are equipped with such bags and retainers, where the possibility of depositing sanitary towels and the like in a closed bag is appropriate, as it is thus avoided that used sanitary articles are thrown into the toilet where they may cause interruptions of outflow or even chokings.

From Danish document No. 113,625 laid open to public inspection is known a frame comprising two carrier rails which are hinged together and are kept compressed by a spring. A bag can be arranged having a mouth channel on each rail so as to manually open the mouth by pressing one rail with a view to disposal of a towel into the bag, whereupon one lets go of the rail and the mouth will close.

However, this carrier frame is difficult to use. It takes some routine to place the bag as there are two channels along the mouth for insertion on each carrier rail while these are in close abutment. Further, the handling of the opening procedure is inconvenient as it is necessary to permanently press against the wall while the towel is taken through the mouth of the bag. The distance between the free part of the rail to be pressed and the mouth of the bag is rather big, and the shape of the mouth is a V-shape. If the frame is mounted in a narrow room, such as a bathroom, such a procedure is difficult and could often cause smudging of the mouth of the bag which is again unhygienic and may give rise to unpleasant odors.

From DE-OS No. 2,304,670 and U.S. Pat. No. 3,912,208 are known bag retainers comprising two resilient rails on to which the mouth of the bag is attachable. By pulling one rail the mouth of the bag will open, and when the pulling ceases, the bag will close again. However, these known retainers are also difficult to handle since it is imperative that the bag is inserted accurately on both rails. Add to this the relatively complex design of the retainer having hinges at the ends of the resilient carrier members, which makes the retainer more expensive and which makes it more difficult to keep the retainer and the suspension clean.

SUMMARY OF THE INVENTION

It is the object of the invention to overcome this large number of drawbacks in known frames, which object is achieved in that the retainer comprises a bracket which is to be mounted on a wall and which carries a traversing carrier rail of a resilient material, and in that the bag is provided with a folded down collar so as to create an inwardly open flap along one or both sides of the top edges of the bag, which flap may be arranged over the carrier rail and be held in the closed position of the bag.

Thus, it is possible by means of only a single carrier rail to both hang the bag and open it by pulling the outer rim of the bag. This procedure ascertains maximum opening, and consequently sanitary towels and similar elongate or rolled up objects will easily pass through the opening into the bag without touching or smudging the rim at all. Further, this design offers a much better contact with the opening of the bag as one actually has a firm grip of the bag and at the same time both sees and feels the opening. Hanging and removal of the bag is extremely simple because only the innermost part of the bag will have to be fitted on the carrier rail which is easy when the rail is spaced from the wall at a convenient distance whereby it only remains to pull the bag on to the retainer. Removal is likewise easy and hygienic as the bag is suspended in one flap only.

The inclined shaping of both the rail and the opposite side edges of the suspension flap makes it easy to fasten the bag because this is self-centering, and further the tensile stress on the upper rim of the bag will be lower, thus facilitating access for the fingers to grip the rim during opening of the bag.

The idea of making the flap higher than the carrier rail makes it possible for the bag—when it is filled and consequently weighted—to slide lower on the carrier rail without weakening the closure although the foil has stretched.

Finally, it is expedient that the rail is outwardly bent at its centre relative to the wall since this makes handling easier.

The invention accordingly comprises the features of construction, combination of elements, and arrangement of parts which will be exemplified in the construction hereinafter set forth, and the scope of the invention will be indicated in the appended claims.

BRIEF DESCRIPTION OF THE DRAWINGS

The invention is further described with reference to the drawing in which.

Figure 1:
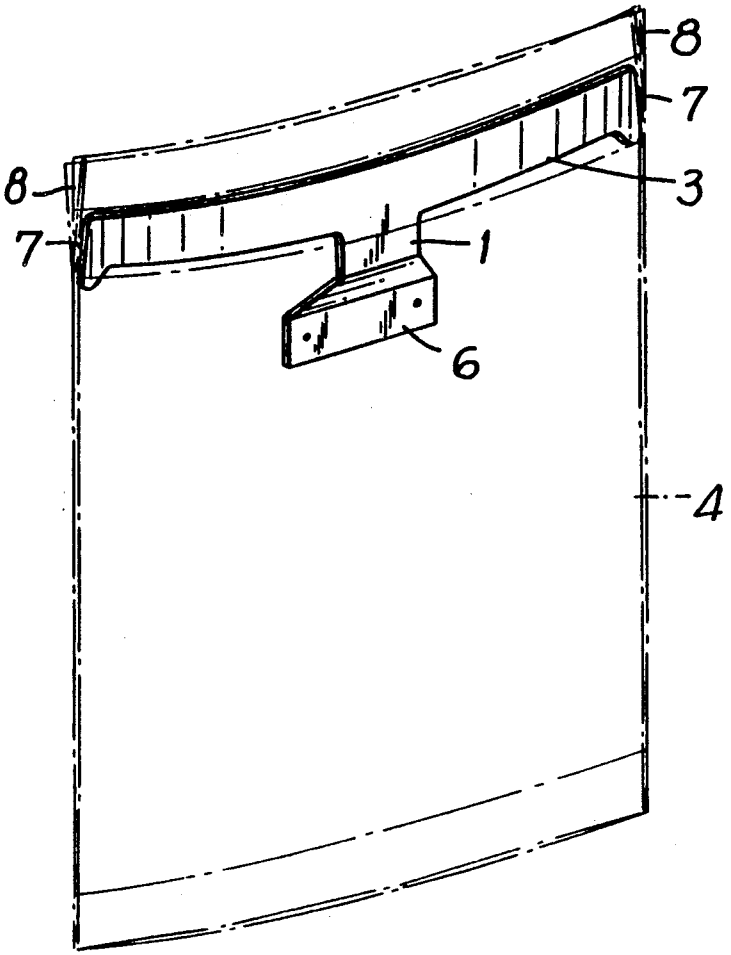
FIG. 1 is a rear view of the retainer with a bag.

An example of an embodiment of the bag and retainer is shown in FIG. 1.

Figure 2:
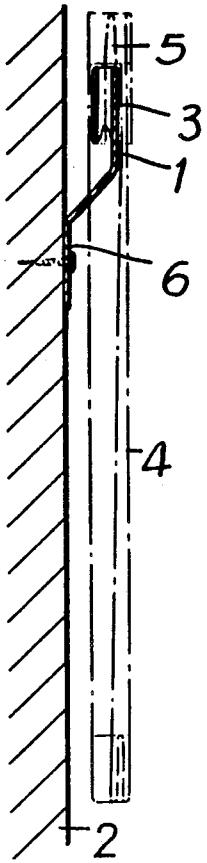
FIG. 2 shows a section through the retainer and the bag, seen in the direction of II—II in FIG. 3.

The retainer comprises a bracket 1 having at its lower part a mounting 6 with holes for fixing screws, as shown in FIG. 2.

Further, at its upper part the bracket 1 is bent outwards so as to be outwardly displaced at its top relative to the mounting 6. Moreover, the actual resilient and arcuate carrier rail 3 is fixed in a horizontal position at the top of the bracket.

At the ends of the carrier rail 3 the edges 7 are sloping having smooth roundings and designed in such a manner that the rail tapers towards its top side.

The retainer may be manufactured of various suitable materials, and of metals rustproof steel is preferable, partly because of its keeping qualities in moist surroundings, and partly because of its fine and stable resilient qualities.

The ends of the rail 3 can be provided with bosses as shown or in a similar manner in order to prevent the bag from being cut or torn by the rail.

Figure 5:
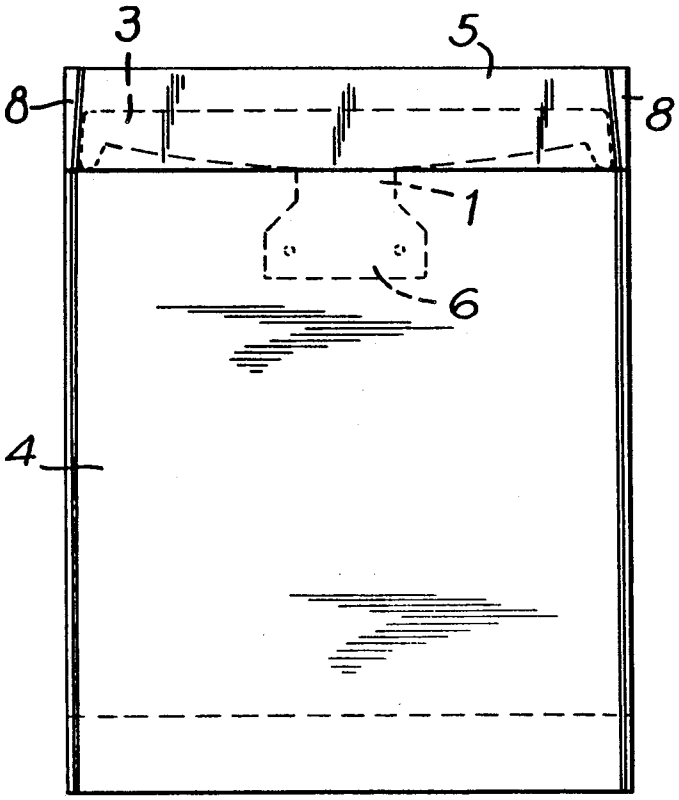
FIG. 5 is a front view of the bag.

The bag may be shaped as shown in FIG. 5. It is mainly manufactured out of plastic foil of a suitably strong quality. PrincipallY, it is produced by welding the side seam of a folded foil lane, and further an outwardly folding of the uppermost piece of foil is provided on the upper part so as to procure a downwardly open flap 5 on the outside of the bag 4. This flap 5 will preferably be available on both sides of the bag meaning that any of the two sides of the bag can be placed on the retainer; furthermore, this makes the use of the bag easier as the rim is easilier gripped.

Further, the side seam 8 at the sides of the flap 5 is sloping rendering the opening of the flap larger at the bottom than at the top. At the bottom this corresponds to the length and shape of the carrier rail 3 allowing hanging of the bag at its lower part, as demonstrated in FIGS. 1 and 2.

Figure 3:
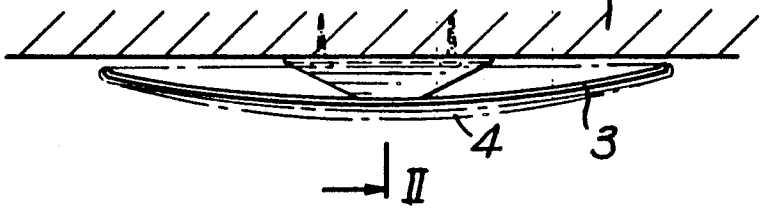
FIG. 3 is a top view of a mounted retainer and bag.

When hanging, the bag and retainer will appear as shown in FIG. 3, in which the retainer is fitted on a wall 2.

Figure 4:
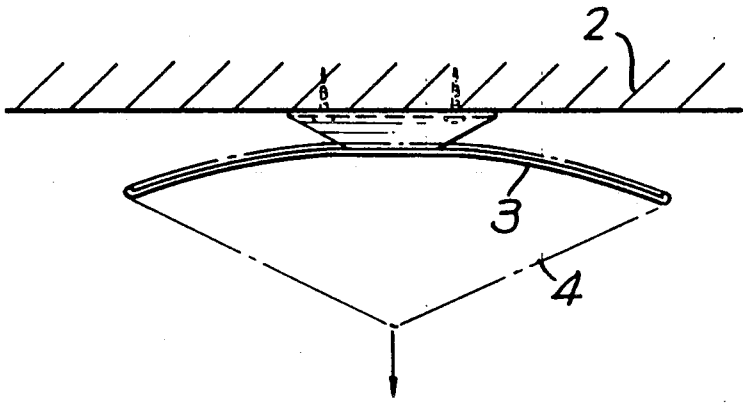
FIG. 4 shows the retainer and the bag in an open position.

When opening the bag 4 one either inserts one finger into the outer flap thus totally avoiding contact with the rim part, or one inserts one finger between the rims of the bag at the top. Thereupon, the free rim of the bag is pulled outwards in the direction of the arrow, as shown in FIG. 4. This position permits disposal of a sanitary towel or the like in the bag which will subsequently return to the closed position shown in FIG. 3 by means of the spring tension of the rail 3.

As the bag is gradually filled or being stretched at its upper part, the flap 5 will slide down on the rail 3 and as a consequence of which the flap and the rail will remain in constant abutment. Thus, the required degree of tension in the rim area of the bag is maintained as is the constant tight closure of the bag whereby unpleasant odor is avoided completely.

When the bag is to be replaced, it is lifted off the rail, i.e. by inserting fingers underneath the flap, and the bag with its contents is lifted off the carrier rail. In that way direct contact with the rim area and the contents is completely avoided, which makes the use of the bag hygienic.

We claim:

1. A bag and a retainer in combination for fitting on a wall or like mounting surface, said retained comprising:

a bracket for attachment to a mounting surface, a single resilient transversing carrier rail of extended length connected proximate its midpoint to said bracket, the longitudinal ends of said rail being unconstrained and subject to independent flexing to vary the distances of said ends from said mounting surface;

said bag comprising a pair of opposite top edges and being movable between a closed position in which said top edges are in close abutment and an open position in which said top edges are spaced from each other, said bag being folded-down forming an opening flap along at least one of said opposite top edges, the length of said flap corresponding with the length of said carrier rail, one said opening flap receiving said rail therein to releasibly hold said retainer and bag together, the opposite top edge of said bag being free of attachment to said carrier rail and positioned on the side of said retainer away from said mounting surface, said rail being subject to flexing by pulling said opposite top edge to said open position.

2. A bag and a retainer as in claim 1, wherein said carrier rail has, in use, a top side and a bottom side and edges at the longitudinal ends of said carrier rail, said edges slope outwards toward the bottom side of said rail, said rail being shorter at its top side than at its bottom side, said flap having end edges, the length and taper of said end edges of said flap at the entrance to said flap corresponding to the dimensions of the ends of said carrier rail.

3. A bag and a retainer as in claim 1, wherein the height of said flap is greater than the width of said rail in the direction transverse to said carrier rail length.

4. A bag and a retainer as in claim 1, wherein said carrier rail when unflexed is curved with said free ends of said rail being closer, when attached to said mounting surface, than the midpoint of said rail.

5. A bag and a retainer as in claim 2, wherein the height of said flap is greater than the width of said rail in the direction transverse to said carrier rail length.

6. A bag and a retainer as in claim 2, wherein said carrier rail when unflexed is curved with said free ends of said rail being closer, when attached to said mounting surface, than the midpoint of said rail.

7. A bag and a retainer as in claim 6, wherein the height of said flap is greater than the width of said rail in the direction transverse to said length of said carrier rail.

8. A retainer for supporting a bag, said retainer allowing opposite top edges of said bag to be moved between a closed position in which the top edges are in close abutment and an open position in which the top edges are spaced from each other, comprising:

a bracket for attachment to a wall or like mounting;

a single resilient carrier rail of extended length, said rail being connected proximate its midpoint to said bracket, the longitudinal ends of said rail being unconstrained and subject to independent flexing, when said bracket is attached to said mounting surface, so as to vary the distance of said ends from said mounting surface, said rail, when unflexed, being curved between said ends, said ends being closer to said mounting surface than said rail midpoint when said retainer is attached to said mounting surface.

9. A retainer as in claim 8, wherein, in use, said rail has a top side and a bottom side, and edges of said carrier rail at said longitudinal ends slop outward toward the bottom side, said rail being shorter in said length direction at its top side than at its bottom side, the length of said rail corresponding to the width of said bag at said top edges.

* * * * *